United States Patent [19]

Giolitti

[11] 4,389,130

[45] Jun. 21, 1983

[54] DEVICE FOR COUPLING AND RELEASING A DAISY WHEEL TYPE MEMBER

[75] Inventor: Nicolo Giolitti, Ivrea, Italy

[73] Assignee: Remington Ind. E Com. De Sistemas Para Escritoria S.A., Rio de Janeiro, Brazil

[21] Appl. No.: 366,563

[22] Filed: Apr. 8, 1982

[30] Foreign Application Priority Data

Apr. 30, 1981 [IT] Italy ..... 67588 A/81

[51] Int. Cl.[3] ..... B41J 1/24

[52] U.S. Cl. ..... 400/144.2; 400/175

[58] Field of Search ..... 400/144.2, 144.3, 175, 400/171, 172, 174, 144.1, 144, 144.4; 474/903; 403/166

[56] References Cited

U.S. PATENT DOCUMENTS

| | | | |
|---|---|---|---|
| 3,983,985 | 10/1976 | Guerrini et al. | 400/144.2 |
| 4,036,348 | 7/1977 | Guerrini | 400/144.2 |
| 4,124,312 | 11/1978 | Johnson | 400/144.2 |
| 4,127,335 | 11/1978 | Bogert | 400/144.2 |

FOREIGN PATENT DOCUMENTS

| | | | |
|---|---|---|---|
| 2924360 | 12/1980 | Fed. Rep. of Germany | 400/144.2 |
| 2950071 | 6/1981 | Fed. Rep. of Germany | 400/144.2 |

OTHER PUBLICATIONS

Xerox Disclosure Journal, vol. 4, No. 2, Mar./Apr. 1979, pp. 175–176 "Print Wheel Removal Assist Means" by Frechette.

*Primary Examiner*—Edgar S. Burr
*Assistant Examiner*—Charles Pearson
*Attorney, Agent, or Firm*—Michael N. Meller; Anthony H. Handal

[57] ABSTRACT

A typewriter (not illustrated) using a daisy wheel as the type carrying member and having a unit which drives the daisy wheel element to rotate about its axis and a device for coupling the daisy wheel element onto the drive unit.

The coupling device substantially comprises a pin which engages a hole in the daisy wheel element; first resilient means carried by the unit and operable to transmit to the daisy wheel element an axial thrust in a first direction; second resilient means operable to transmit to the daisy wheel element an axial thrust in a direction opposite the thrust generated by the first mentioned means; and manual control means which act on the said second resilient means in such a way as to compensate, if actuated, the thrust generated by such second resilient means.

10 Claims, 4 Drawing Figures

DEVICE FOR COUPLING AND RELEASING A DAISY WHEEL TYPE MEMBER

BACKGROUND OF THE INVENTION

The present invention relates to a device for rapid coupling and releasing of a character support member of the daisy wheel type in a typewriter. Character support members of the daisy wheel type are, as is known, constituted substantially by a circular flat element having a central hub from which extend radial projections commonly called "petals". On the end of each projection there is formed a character which from time to time is pressed against the surface of the sheet to be typed carried by the roller of the machine by means of a suitable type bar. The daisy wheel support member is connected to a drive element which causes the member to rotate about its axis in such a way that the character which is to be impressed on the sheet to be typed is selected at the appropriate time.

Often it is necessary to use different sets of type characters, and for this purpose it is necessary at the appropriate time to mount a suitable character support member on the drive element. Currently, the replacement of the character support member is effected either by displacing the typewriter ribbon cartridge or by rotating the whole of the typing head about a pivot, in such a way that access can be easily gained to the hub of the said daisy wheel character support member. Devices which allow snap-engagement of the daisy wheel member also exist, but these devices do not establish the correct positioning of the daisy wheel member itself particularly precisely and any way often cause a loss of time to a user who is not particularly skillful in replacing the above mentioned daisy wheel member.

SUMMARY OF THE INVENTION

The object of the present invention is that of providing a device for rapidly coupling and releasing a character support member of the daisy wheel type which will be substantially free from the disadvantages of the known devices described above, and which will be simple to use whilst at the same time permitting an extremely precise positioning of the daisy wheel support member with respect to the associated drive element.

The said object is achieved with the present invention in that it relates to a typewriter utilising a daisy wheel element as the typing member, and having a drive unit which drives the daisy wheel element to rotate about its axis and which also serves as a support element for the said daisy wheel element, and a device for coupling the said daisy wheel element to the said drive unit, characterised by the fact that the said coupling device comprises:

a pivot projecting axially from the said drive unit and engageable in an axial through hole of the said daisy wheel element;

first resilient means carried by the said drive unit on the side facing the said daisy wheel element and acting in such a way as to create a thrust tending to space the said daisy wheel element from the said drive unit;

second resilient means which transmit to the said daisy wheel element, from the side opposite that facing the said drive unit, a thrust having a greater magnitude and an opposite direction to the thrust exerted by the said first resilient means; and manual control means which act on the said second resilient means in such a way as to compensate, if actuated, the thrust produced by the said second resilient means.

BRIEF DESCRIPTION OF THE DRAWINGS

For a better understanding of the present invention a preferred embodiment of a rapid coupling and uncoupling device for a daisy wheel element will now be described by way of non limitative example, with reference to the attached drawings, in which.

DETAILED DESCRIPTION OF THE INVENTION

Figure 1:
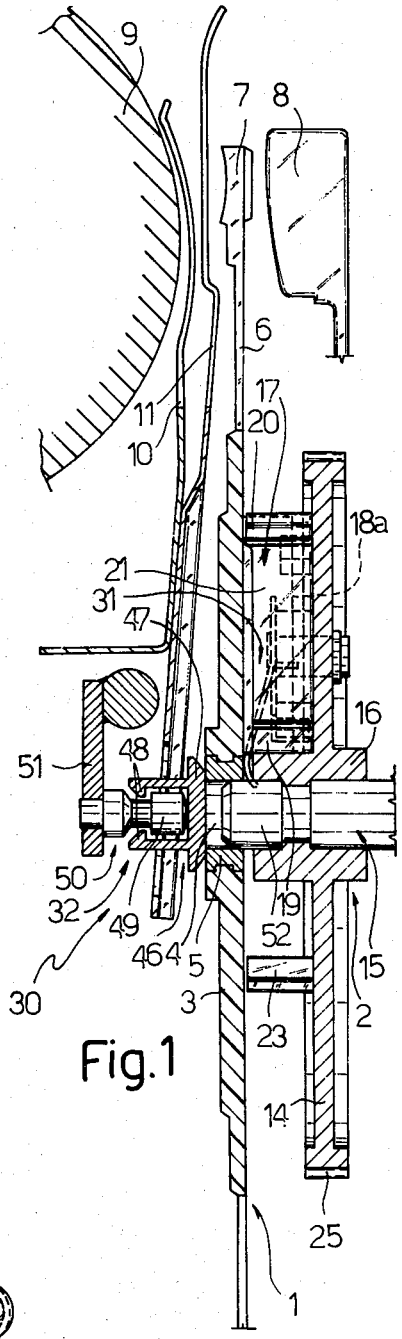
FIG. 1 is a side view in section of a device formed according to the present invention.

With particular reference to FIG. 1, a daisy wheel element is generally indicated with the reference numeral 1; this is driven to rotate about its own axis by means of a drive unit 2. The daisy wheel element 1 is of a substantially known type and has a circular hub 3 with an axial through hole 4 in which is fitted a bush 5; from the outer surface of the hub 3 radial projections commonly called "petals" and indicated with the reference numeral 6, extend radially outwardly; each of these petals carries at its radially outer end a portion 7 on which a predetermined type character is impressed. A type bar is generally indicated with the reference numeral 8; this is operated in a manner which is not illustrated in the drawings to cause the end 7 of each petal 6 to be pressed against the facing surface of a roller 9 on which, in use, there is carried a sheet to be typed. The reference numerals 10 and 11 indicate two shaped elements of known type which, respectively, allow the sheet to be typed to be held correctly pressed on the surface of the roller 9 and guide the typewriter ribbon in front of each end portion 7 of the above mentioned daisy wheel element 1.

The drive unit 2 substantially comprises a disc 14 and a spindle 15 which carries the disc 14 and to which a hub 16 of the disc 14 itself is angularly coupled. From the hub 16 of the disc 14 there extends radially a radial rib 17 (see also FIG. 3) which serves as a guide for two projections which extend parallel to one another and substantially radially of the hub 3 of the daisy wheel element 1. The radial rib 17 has a root 19 and an end portion 20 which both have a width greater than an intermediate rectilinear section 21; moreover, the end portion 20 has rounded edges (see also FIG. 3). Each radial projection 18*a*, 18*b* cooperates with the rib 17 only at the root 19 and the end portion 20 of this latter, and has, moreover, a respective outwardly extending tongue 22*a*, 22*b* which is engageable on the surface of the hub 16 of the disc 14.

The disc 14 also has a pair of projections 23, 24 which, together with the end portion 20 of the radial rib 17 constitute a set of three elements disposed equi-distantly around a circumference and defining a contact plane for the hub 3 of the daisy wheel element 1. Finally, on the peripheral surface of the disc 14 there are formed teeth 25 which, in a manner not illustrated, are conveniently engaged by a pinion of a small motor (not illustrated) which controls the rotation of the disc 14 about the spindle 15.

According to the present invention there is provided a device 30 which controls the coupling or releasing of the daisy wheel element 1 with respect to the drive unit 2 and which is substantially constituted by a first assembly 31 of resilient means carried by the drive unit 2 and acting on the surface of the daisy wheel element 1 on the side facing the unit 2, and by a second assembly 32 of resilient means provided with respective movement transmission mechanisms which act on the surface of the daisy wheel element 1 on the side opposite that facing the drive unit 2. The resilient means 31 are clearly visible in FIGS. 3 and 4 and are substantially constituted by a pair of levers 34*a*, 34*b* each of which is rotatably mounted about a respective pivot 35*a*, 35*b* against a resilient action exerted by a biasing spring 36*a*, 36*b*. These latter are anchored at a first end to a respective projection 37*a*, 37*b* extending from the levers 34*a*, 34*b* and at an opposite end to a peg 38*a*, 38*b* extending from the disc 14.

Figure 3:
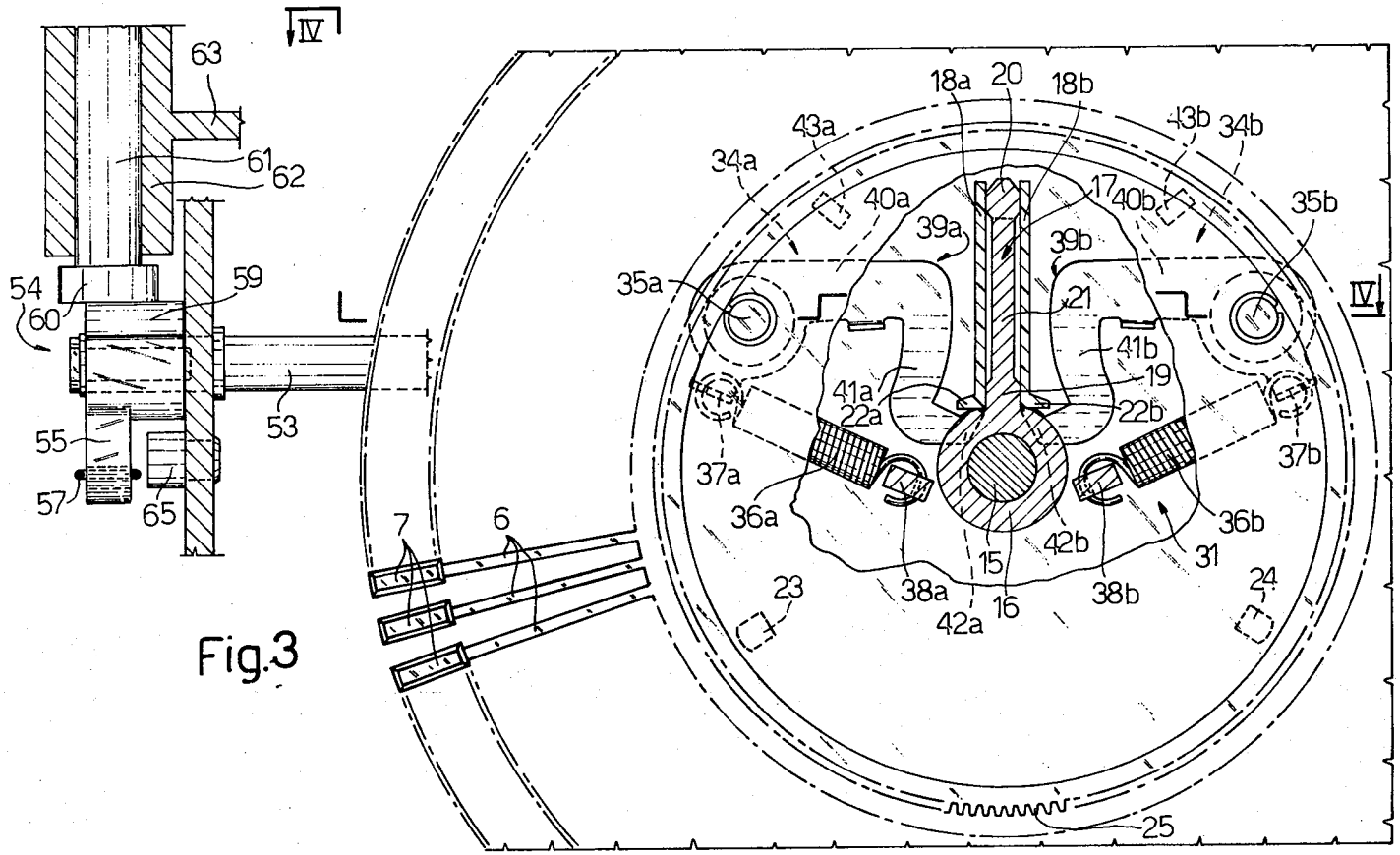
FIG. 3 is a front view, partially in section, of the device of FIG. 1.
Figure 4:
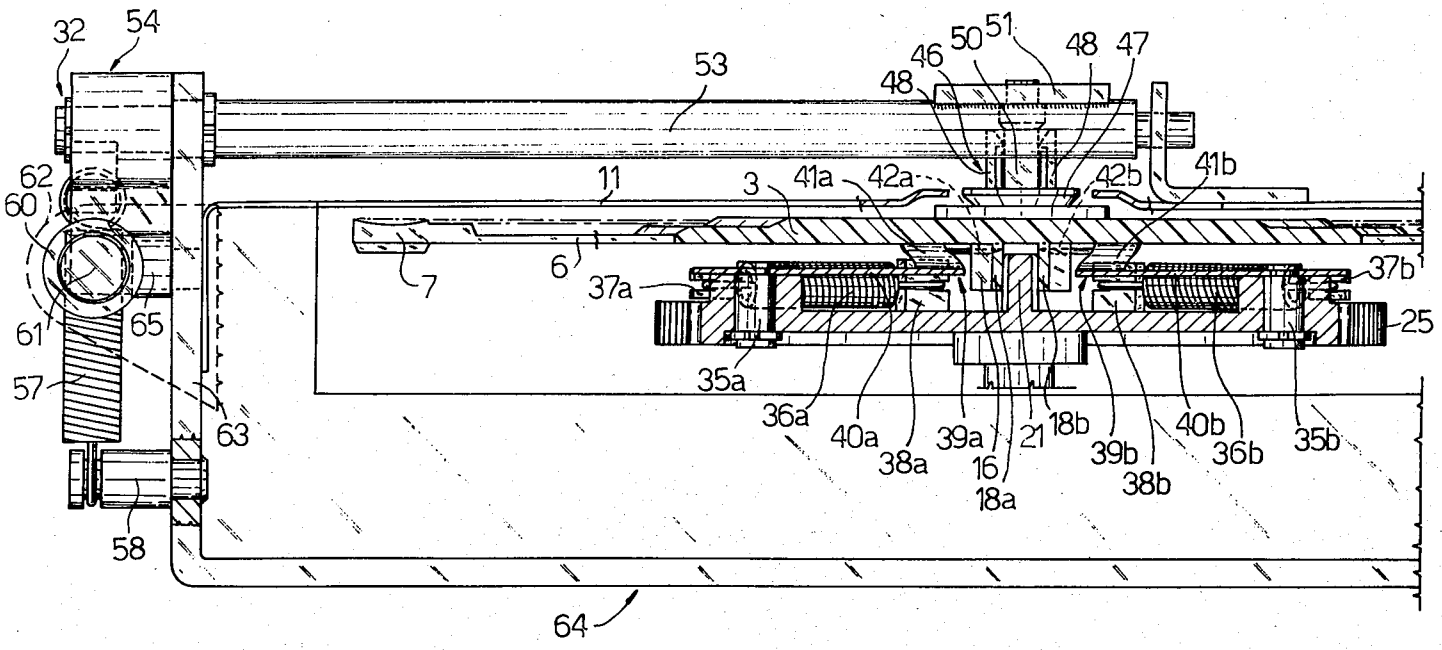
FIG. 4 is a section taken on the line IV—IV of FIG. 3.

With particular reference to FIGS. 3 and 4, it can be seen that each lever 34*a*, 34*b*, which is conveniently made of resiliently deformable material, has an arm 39*a*, 39*b* substantially constituted by a flat part 40*a*, 40*b* and by a raised portion 41*a*, 41*b* folded at 90° with respect to the above mentioned flat part 40*a*, 40*b*. Each portion 41*a*, 41*b* has, moreover, at its end a respective tooth 42*a*, 42*b* for cooperating with the tongue 22*a*, 22*b* respectively of the parallel projections 18*a*, 18*b* extending from the hub 3 of the daisy wheel element 1. Finally, two stop elements 43*a*, 43*b* are provided, each of which prevents a respective lever 34*a*, 34*b* from being able to rotate beyond a certain angle under the resilient action exerted by the spring 36*a*, 36*b*.

The resilient means 32 substantially comprise a cap 46 having a flat top wall 47 and toothed projections 48 which snap-engage the cap 46 to the rounded head 49 of a pin 50 carried by a plate 51, as will be seen below, the head 47 of the cap 46 is resiliently thrust against the bush 5 of the daisy wheel element 1 in such a way that the hole 4 of the bush 5 itself is engaged by a head 52 projecting from the pin 15 of the drive unit 2 beyond the surface of the hub 16 of the disc 14.

Figure 2:
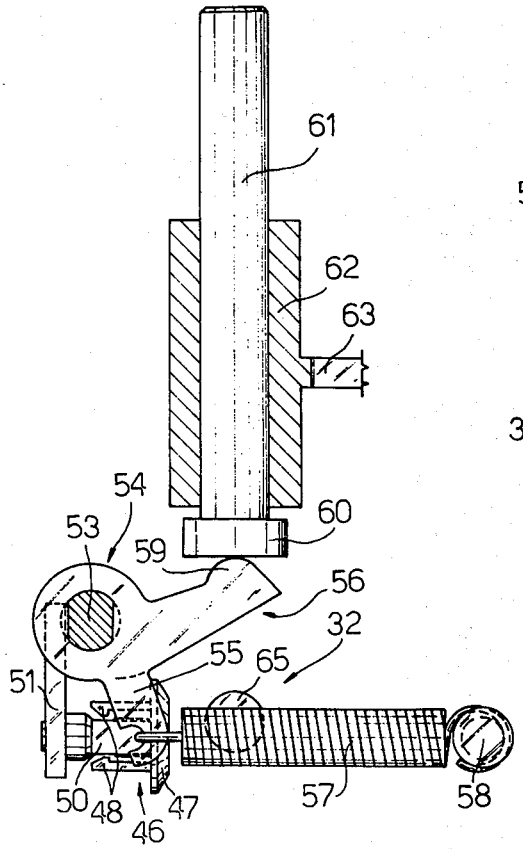
FIG. 2 is a sectional side view of a part of the device of FIG. 1.

With reference also to FIG. 2, the plate 51, at the end opposite that carrying the pin 50 is connected, preferably by means of welding, to an end portion of a shaft 53 which carries at its opposite end a bell crank lever 54 having two arms 55, 56 extending at right angles to one another. The arm 55 is connected by means of a spring 57 to a peg 58; the arm 56 has a rounded end portion 59 against which abuts an enlarged head 60 of a cylindrical push rod 61. This latter can slide within a tubular guide 62 connected to a wall 63 of a support frame 64. There is also provided a peg 65 which serves as a stop against clockwise angular displacements of the arm 56 of the lever 54. Conveniently, the length of the push rod 61 is such that it can easily be actuated, in particular thrust in a longitudinal direction, by the user of the typewriter.

Coupling and uncoupling of the daisy wheel element 1, as well as the drive of this element is effected in the following way.

Supposing, for example, that the daisy wheel element 1 is already correctly coupled as substantially illustrated in FIG. 1; in this position it is conveniently driven to rotate about the spindle 15 by the disc 14 via the radial rib 17 which is locked between the two radial projections 18*a*, 18*b* carried by the daisy wheel element 1.

If it is desired to remove and replace the daisy wheel element 1, it is sufficient to act on the push rod 61, pressing this latter downwards as illustrated in FIG. 2. In fact, displacement of the push rod 61 downwards causes a clockwise rotation of the shaft 53 by means of the lever 54 and against the resilient action exerted by the opposing spring 57. The shaft 53 turns the pin 50 in an anti-clockwise sense (FIGS. 1 and 2) by means of the small plate 51, consequently causing a displacement from right to left of the cap 46.

In the correct operating conditions, the hub 3 of the daisy wheel element 1 is stressed by two resilient forces of opposite sign, the first of which is that exerted by the head 47 of the cap 46 by the effect of the above mentioned spring 57 and the second of which is exerted by the pair of folded over portions 41*a*, 41*b* of the levers 34*a*, 34*b*. At the design stage the values of these two forces of opposite sign will have to be conveniently set in such a way that the resilient force on the hub 3 generated by the spring 57 predominates so that the hub 3 of the daisy wheel element 1 is held constantly in position on the projections 23, and 24 and on the end portion 20 of the rib 17.

The removal of the axial thrust exerted by the cap 46 allows the axial outward thrust transmitted to the hub 3 of the daisy wheel element 1 by the folded over portions 41*a*, 41*b* of the levers 34*a*, 34*b* to predominate. This resilient force tends to separate the hub 3 from the support and drive disc 14 and, when the bush 5 no longer engages the head 52 of the spindle 15, the daisy wheel element 1 can be removed easily. This removal is further facilitated by the combined action which the levers 34*a* and 34*b* exert on the tongues 22*a*, 22*b* of the projections 18*a*, 18*b* of the daisy wheel element 1 via the respective springs 36*a*, 36*b*. In fact these latter exert on the daisy wheel element 1, via the levers 34*a*, 34*b* mentioned above, a thrust in the vertical direction which carries the end portions of the element 1 itself to a position for example one or two cm. above the type bar 8 in such a way that the element 1 can easily be gripped and removed by the user.

The coupling of a new daisy wheel element 1 is effected by inserting this element in such a way that the radial guide projections 18*a*, 18*b* engage the radial rib 17. When the tongues 22*a*, 22*b* abut on the respective teeth 42*a*, 42*b* it is necessary to exert a force by pressing downwardly from above on the daisy wheel element 1 (see FIGS. 1 and 4) in such a way as to overcome the resilient reaction exerted by the springs 36*a*, 36*b*. In the course of this phase the push rod 61 is held constantly pressed. When the tongues 22*a* and 22*b* of the projections 18*a* and 18*b* abut on the hub 16, the release of the push rod 61 causes an axial thrust on the hub 3 of the daisy wheel element 1 by the head 47 of the cap 46; this axial thrust causes coupling of the bush 5 into the head 52 of the spindle 15. The position of the element 1 is now stably maintained in that, as already mentioned, the thrust exerted by the cap 46 due to the action of the spring 57 is conveniently greater than the thrust in the opposite direction exerted on the hub 3 by the folded over portions 41*a*, 41*b* of the levers 34*a*, 34*b*.

From an examination of the characteristics of the device 30 discussed above it can be seen that it allows the above specified objects to be achieved. The device 30 in fact allows coupling and uncoupling of the element 1 in an extremely rapid and simple manner, it being in fact sufficient to press the push rod 61. The positioning of the element 1 is now extremely precise in that it is guaranteed by the elements 23, 24 and by the end portion 20 of the radial rib 17 which also performs the function of driving the daisy wheel element 1.

Finally, it is clear that the device 30 can be modified and varied without by this departing from the scope of the present invention.

I claim:

1. A typewriter having a daisy wheel type member (1) having an axial hole, and a drive unit (2) which drives the said daisy wheel (1) to rotate about its axis and which serves as a support element for the said daisy wheel (1), and a device for coupling the said daisy wheel (1) with respect to the drive unit (2), said coupling device (30) comprising:

a spindle (15) projecting axially from the said drive unit (2) and engageable in said axial through hole (4) of the daisy wheel (1);

means for creating a first thrust tending to separate said daisy wheel (1) from said drive unit (2), said means for creating a first thrust comprising first resilient means (34*a*,34*b*) engaging said daisy wheel and being carried by said drive unit (2) on the side of said drive unit facing said daisy wheel (1);

means for creating a second thrust acting on said daisy wheel, said second thrust having a greater magnitude and opposite direction from said first thrust, said means for creating a second thrust comprising a second resilient means (57) which engages said daisy wheel on the side opposite that facing said drive unit (2); and manual control means for selectively disengaging said second resilient means from said daisy wheel, thus eliminating said second thrust and permitting said first thrust to disengage said daisy wheel from said spindle.

2. A typewriter according to claim 1, wherein said drive unit (2) includes a disc (14) driven to rotate by a motor; said first resilient means (34*a*, 34*b* ) being mounted on one surface of the said disc (14).

3. A typewriter according to claim 2, wherein said first resilient means (34*a*, 34*b*) comprise at least one resiliently deformable plate (39*a*, 39*b*) having a bent portion (41*a*, 41*b*) which presses axially on the surface of a hub (16) of said daisy wheel (1).

4. A typewriter according to claim 3, wherein said plate (39*a*, 39*b*) comprises a first arm of a lever (34*a*, 34*b*) rotatably mounted about a pin (35*a*, 35*b*) and provided with a second arm (37*a*, 37*b*) connected to the said disc (14) by means of third resilient means (36*a*, 36*b*).

5. A typewriter according to claim 4, wherein said disc (14) has a radial rib (17) which is engageable in a region of said daisy wheel (1) delimited by respective radial projections (18*a*, 18*b*), and in that two of said levers (34*a*, 34*b*) are mounted on opposite sides of said radial rib (17) and have on said first arm (39*a*, 39*b*) a respective tooth (42*a*, 42*b*) cooperable with an end of the radial projection (18*a*, 18*b*) carried by said daisy wheel (1).

6. A typewriter according to claim 1, further including a mechanism which forms an operative connection between said second resilient means (57) and said daisy wheel element (1), said mechanism comprising a shaft (53) which carries, at a first end, a lever (54) having an arm (55) connected to said second resilient means (57), and at a second end, a pin (50) on which is mounted a cap (46) which abuts against the surface of a hub (3) of said daisy wheel element (1).

7. A typewriter according to claim 6, wherein said pin (50) has a rounded head (49) which is adjustable relative to said cap (46).

8. A typewriter according to claim 6 wherein said cap (46) is in the form of a cup and has toothed projections (48) on the lateral parts thereof, said toothed projections enabling a snap-mounting of said cap on head (49) of said pin (50).

9. A typewriter according to claim 6 wherein said lever (54) has a further arm (56) on which said manual control means (61) acts.

10. A typewriter according to claim 9, wherein said manual control means (61) includes a push rod (61) axially slidable within a tubular guide (62) and having a first end which cooperates with said further arm (56) of said lever (54) and a second end able to receive an axial thrust.

* * * * *